United States Patent [19]

DaMert

[11] 4,094,084

[45] June 13, 1978

[54] CURVED PRISM ORNAMENT

[76] Inventor: Fred Allen DaMert, P.O. Box 36, Oakland, Calif. 94604

[21] Appl. No.: 682,886

[22] Filed: May 3, 1976

[51] Int. Cl.[2] ..... G09F 19/02

[52] U.S. Cl. ..... 40/613; 40/617

[58] Field of Search ..... 40/138, 139, 37; 240/76, 10 R; D48/14; 350/286, 287, 99; 428/9, 16, 28

[56] References Cited

U.S. PATENT DOCUMENTS

| | | | |
|---|---|---|---|
| D. 171,594 | 3/1954 | Hagey | 40/138 X |
| 909,507 | 1/1909 | Zubli | 240/10 R |
| 1,211,239 | 1/1917 | Ryan | 240/10 R |
| 1,976,093 | 10/1934 | Raymond | 40/138 X |
| 2,197,577 | 4/1940 | Crosser | 40/138 X |
| 3,762,084 | 10/1973 | Jones | 40/138 |

*Primary Examiner*—Louis G. Mancene
*Assistant Examiner*—Wenceslao J. Contreras
*Attorney, Agent, or Firm*—Townsend and Townsend

[57] ABSTRACT

An optical ornament, novelty or plaything comprised of a hanging curved prism pivotally suspended for movement in air currents, as a mobile, whereby incident light (preferably sunlight) is transmitted through the prism and projected against a surface (interior walls of a building) to provide colorful, ornamental spectra thereon. The curved prism is triangular in cross-section, elongate, and curved about an axis which lies parallel to the radially innermost face, outside of the transparent member, and extends generally perpendicular thereto. The curved prism is of any transparent material and may be colored or tinted to provide color filtering. The curved prism is provided with a small finger member projecting midway from the radially innermost prism surface. When the prism is supported at or hung from this finger member the prism balances in equilibrium in a generally horizontal attitude. The finger member has multiple suspension points which, when the prism is suspended from different ones of said suspension points, causes the spectrum projection angle of the prism to be varied relative to the horizon.

7 Claims, 10 Drawing Figures

CURVED PRISM ORNAMENT

SUMMARY OF THE INVENTION

The present invention relates to an optical ornament, novelty or plaything; and more particularly to a curved prism for projecting an ornamental curved spectrum. Still more particularly, the present invention relates to a curved prism which may be suspended or supported in a pivotal fashion to rotate as in air currents or with a motor. Moreover, the present invention relates to pivotally suspended or supported curved prisms having suspension means consisting of a finger or the like extending from a radially inner face of the prism from which the prism may be balanced, such finger being curved, notched, or otherwise suited to provide multiple or variable suspension points whereby the projection angle of the balanced prism may be adjusted by selecting among the various projection points. Preferably, the curved prism is hung from a thread, filament or other similar means whereby the prism will rotate freely in light air currents, as a mobile, thereby causing continuous changes in the character and shape of the projected spectrum to provide interesting, decorative optical events.

Previously, prisms have been employed as ornaments. For example, chandeliers have embodied hanging prismatic glass or crystal pendants and lusters to disburse light from the chandelier itself.

Distinguishing from past ornamental prism articles, the present prism is characterized by a curved configuration. This curvature by itself and in combination with pivotal suspension creates unusual optical and decorative lighting events. Such features are further enhanced by making the prism's suspension angle adjustable, thereby making the spectrum projection angle adjustable.

The curved prism of the present invention is primarily intended to be hung in direct sunlight in a room, such as at a window, to create and project spectra on interior walls and other interior surfaces not located in direct sunlight.

As used to describe the present invention, the term "prism" herein refers to a "curved prism". A curved prism is similar to a true prism in that its function is to disperse a beam of light, but it is different in that the non-parallel faces used for such dispersion are curved, not planar. Typically, such curvature is about an axis running perpendicular to the prism's long dimension. Occasionally, there is also a curvature about an axis running parallel to the prism's long dimension.

BRIEF DESCRIPTION OF THE DRAWINGS

FIG. 3A shows the prism suspended at a projection angle roughly parallel to the horizon.

FIGS. 4A, B and C show different angles of projection which are obtained by selecting different notches as suspension points.

DESCRIPTION OF THE PREFERRED EMBODIMENT

Figure 3A:
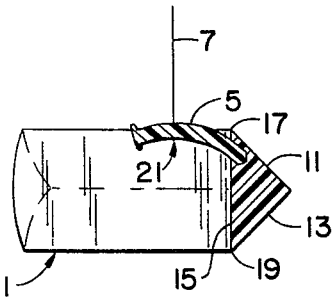
FIGS. 3A, B, and C are side sectional elevations of the curved prism of FIG. 2, taken along the line 3—3, showing the prism hung at different attitudes relative to the horizon by selecting different suspension points along the length of a small curved finger extending from the projection face of the prism.
Figure 3B:
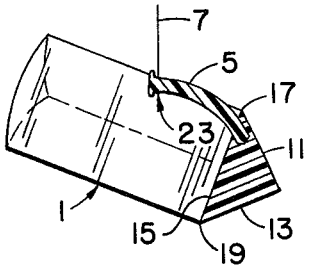
FIG. 3B shows the curved prism suspended with its projection angle directed upward and FIG. 3C shows the curved prism suspended with its projection angle directed downward.
Figure 3C:
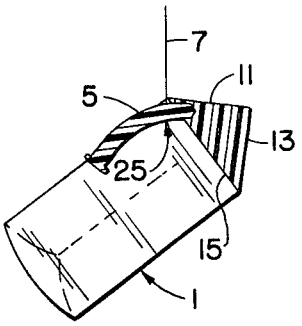

FIGS. 1, 2 and 3A–C, inclusive, depict a preferred embodiment of the present invention comprised of a curved prism 1 which is a transparent member 1 shaped like a prism which has been bent to curve about an exterior axis 3; and a finger 5 which serves as means for pivotally suspending the transparent member 1 by a thread, string or other filament 7. The curved transparent member 1 is elongate and triangular in cross section, as best shown in FIGS. 3A–C; and has triangular opposed end surfaces 9 and elongate curved rectangular faces 11, 13 and 15. Faces 11 and 13 are at right angles relative to one another; whereas the remaining face 15, sometimes herein referred to as the "radially inner face" 15, forms 45° angles to the other faces 11 and 13. (By referring to the faces 11, 13 and 15 as "curved rectangular" it is understood that they are not necessarily true rectangles, but have the appearance of a rectangle which has been distorted through simple curvature about a single axis 3.) The suspension finger 5 extends from the radially inner face 15 midway between the ends 9 and near the upper edge 17 of the transparent member 1. The finger 5 curves downwardly about an axis extending generally parallel to the transparent member 1 and beneath the finger 5.

FIGS. 3A, B and C depict the attitude of the transparent member 1 relative to the horizon when suspended at different suspension points 21, 23 and 25 from the filament 7. The radially inner face 15 faces higher when a suspension point is selected which is relatively distant from the transparent member 1 (e.g., at suspension point 23 in FIG. 3B) whereas the radially inner face faces lower as the suspension point is moved toward the transparent member 1 (e.g., at suspension point 25 in FIG. 3C). By selecting different suspension points, the angle at which light emerges from the transparent member 1 (sometimes hereinafter referred to as the projection angle) may be adjusted or varied relative to the horizon.

Figure 1:
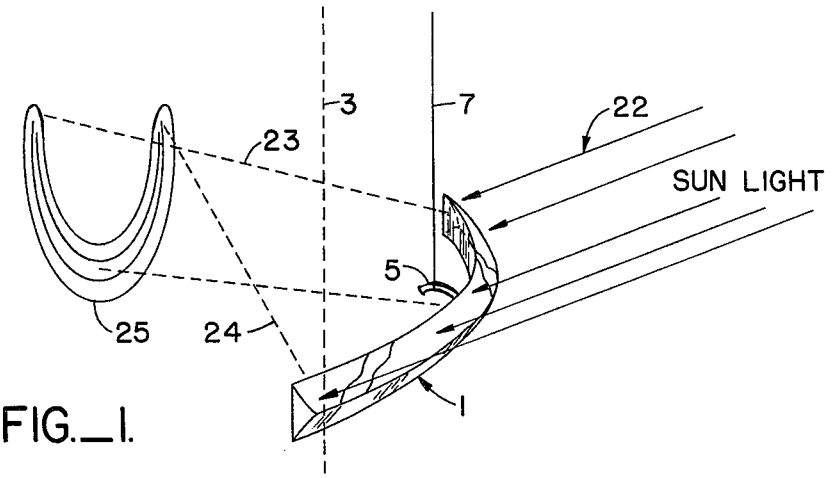
FIG. 1 is a perspective view of a curved prism according to the present invention hung in sunlight and projecting a curved spectrum on a wall or other vertical surface.
Figure 2:
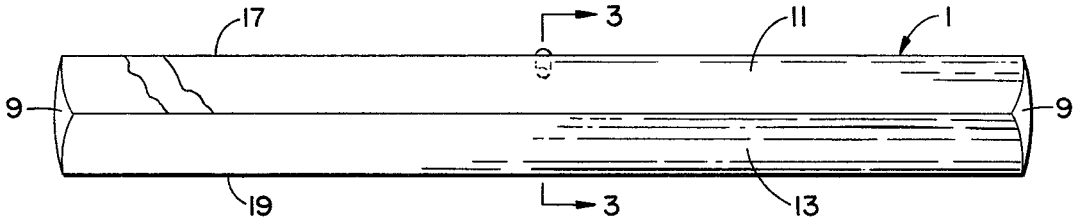
FIG. 2 is a rear elevation of the curved prism of the present invention.
Figure 5:
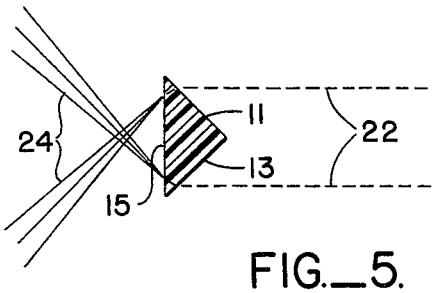
FIG. 5 is a diagram depicting spectral diffraction of light incident upon each of the two rear faces of the prism and emerging from the projection face.
Figure 6:
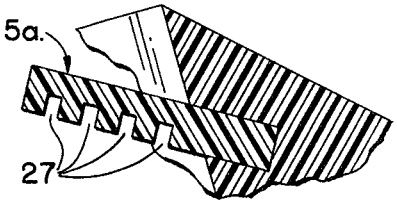
FIG. 6 is an enlarged sectional view, with portions cut away, of the notched finger shown in FIGS. 4A, B and C.

In operation, as best shown in FIG. 1, the curved prism is hung by a thread 7 in direct sunlight. The effect of the prism upon sunlight incident upon radially outer faces 11 and 13, emerging from radially inner face 15 is depicted in the diagram of FIG. 5. Incident light is represented by the numeral 22 and exiting light is indicated by the numeral 24. Light projected from the radially inner face 15 tends to form a curved spectrum (depicted by the numeral 25 in FIG. 1) when projected upon a surface, although it will be appreciated that the curved spectra of the present invention will vary in shape dependent upon the angle of incident light, the projection angle of the spectrum, and the shapes and relative angles of different projection surfaces. Likewise, different spectra can be produced by varying the cross-sectional configuration of the curved prism 1, such as by changing the relative angles of the faces, changing their shapes, or by increasing the number of the prism faces and/or curvatures.

It will be observed that light falling upon the radially inner face 15 will exit from one of the radially outer faces 11 or 13. Such exiting light forms an ornamental curved spectrum similar, though not identical, to spectrum 25. In certain circumstances, these oppositely formed spectra are more interesting and dramatic than those projected from the radially inner face 15.

Figure 4A:
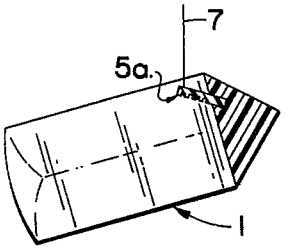
FIGS. 4A, B and C are side sectional elevations of the curved prism of the present invention wherein the curved finger of FIGS. 3A, B and C has been replaced by a notched finger.
Figure 4B:
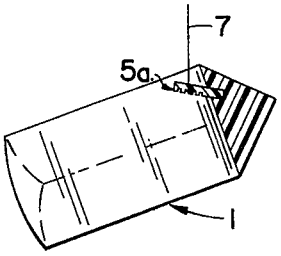
Figure 4C:
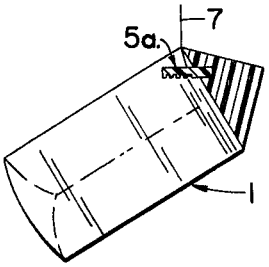

As depicted in FIGS. 4A, B, C and 6, at numeral 5a, the suspension finger 5 can be straight and provided with notches 27 along its bottom edge. Each notch 27 can be selected as a separate suspension point which, when the curved prism is suspended therefrom, adjusts its projection angle.

As is preferred, the suspension fingers 5, 5a are glued or otherwise permanently fixed in the body of the transparent member 1.

The material for the transparent member 1 is preferably a molded mixture of polyester and acrylic resins. Such mixture can be supplemented with inorganic pigments for tinting. Other suitable materials for the transparent member include glass and other plastics. Additionally, the transparent member could be a rigid transparent shell filled with a transparent liquid.

The transparent member 1 is tinted both to enhance its own appearance and to provide variety in the spectra colorations which can be produced. In this respect, it will be appreciated that a prism of a particular tint tends to filter or dim other colors, passing its own color freely. In this manner, the visual effect is to produce a spectrum wherein the color of a particular prism appears to be enhanced in spectra produced by such prism. Thus, a blue tinted prism will tend to produce a spectrum wherein the blues appear to be enhanced relative to other colors, although, in reality, the other colors are simply dimmed.

The radius of curvature of the spectrum can be varied as desired. Curvature of the prism tends to focus or concentrate light projected therefrom, thereby increasing the intensity of colors in the spectrum. While the preferred embodiment has a generally circular curvature, other curvatures will produce spectra of different shapes and appearance due to variations in focal points and color intensity of light spectra projected therefrom. Thus, for example, the curved prism of the present invention could have parabolic, elliptical, oval or other curvature to produce different optical effects.

As is preferred, the curved prism is suspended from a thread, filament, string or other similar means for allowing the prism to rotate freely in air currents. However, the prism could likewise be supported from beneath by an upright rod or the like which could be pointed and seat in a recession formed in the suspension finger, thereby allowing the curved prism to rotate freely in air currents in the same manner as when suspended by a thread. Alternatively, the prism could be mounted fixedly, such as upon a stand, so as to be stationary and not rotate. In such alternate embodiments, the prism mounting can be adjustable to vary the projection angle. A further alternative is to drive the prism in rotation with a motor, such as by using the motor to twist a string from which the prism is suspended or to rotate a rod from which the prism is supported.

It will be understood that the present invention pertains to curved prisms which transmit light to project spectra upon remote surfaces. The curved member is typically transparent; it will be appreciated that translucent materials may also provide suitable spectral projections, although as the degree of diffusion increases, the intensity and clarity of the spectrum tends to diminish which is generally undesirable. Thus, where I use the term "transparent" herein, I do not mean to exclude materials which might also be characterized as translucent, so long as they are suited for production of decorative spectra, although translucent materials must generally have a degree of transparency to be useful for this purpose.

While the salient features of the invention have been shown and described with respect to several embodiments, and while several modifications to those embodiments have been described, it will be readily apparent that numerous further modifications may be made within the spirit and scope of the invention and it is, therefore, not desired to limit the invention to the exact details shown or described except insofar as they may be defined in the following claims.

Having thus described my invention, I claim:

1. An optical ornament comprising:

an elongate arcuate transparent member shaped like a prism which has been curved about an exterior axis perpendicular to its length; and suspension means located midway between the ends of said member so that said member may be pivotally suspended in a horizontal attitude, said suspension means comprising a finger extending from a radially inner surface of said member; and, whereby said member may rotate freely in response to air currents.

2. The ornament of claim 1, wherein said finger has a plurality of suspension points from which said member may be suspended, and wherein the angle of said radially inner face may be varied relative to the horizon by suspending said member from different ones of said suspension points.

3. The ornament of claim 2 wherein said finger is curved about an axis which, when said member is pivotally suspended from said finger, is horizontal and beneath said finger.

4. The ornament of claim 2 wherein said finger is provided with a plurality of notches which serve as and thereby locate said suspension points at various positions along said finger.

5. A mobile comprising:

an elongate prismatic member, triangular in cross-section, having three curved rectangular faces, the radially inner one of said faces being curved about an axis parallel thereto and perpendicular to but not intersecting said member; a finger extending from the radially inner one of said three faces, from a position intermediate the ends of said member whereby said member may rotate freely in air currents or the like; and means for positioning said member in a beam of light whereby light incident upon one of said faces emerges from another of said faces to produce a curved spectrum.

6. An optical ornament comprised of a curved prism and means for positioning said prism in a building in a beam of incident sunlight whereby sunlight passing through said prism may be projected upon a wall or other interior surface of the building to form a curved decorative color spectrum thereupon; wherein the projection angle of said prism is adjustable.

7. An optical device for projecting spectra comprising:

a curved elongate prism having an elongate concave radially inner face; and support means comprising a small finger extending from said radially inner face for supporting said prism in balanced equilibrium, said means located midway between the ends of said prism.

* * * * *